United States Patent [19]

Landsberger

[11] Patent Number: 4,509,228

[45] Date of Patent: Apr. 9, 1985

[54] INFLATABLE IMPLEMENT HANDLE

[76] Inventor: Kurt Landsberger, 103 Harrison St., Verona, N.J. 07044

[21] Appl. No.: 472,046

[22] Filed: Mar. 4, 1983

[51] Int. Cl.[3] ..... B25G 1/00

[52] U.S. Cl. ..... 16/114 R; 16/116 R; 16/DIG. 12; 16/DIG. 24

[58] Field of Search ..... 16/114 R, 114 A, 114 B, 16/116 R, 111 R, 110 R, DIG. 12, DIG. 24, DIG. 25, DIG. 40, DIG. 41, DIG. 18, DIG. 19; 128/77; 279/1 Q; 273/81.4, 75; D8/307, 310, DIG. 7

[56] References Cited

U.S. PATENT DOCUMENTS 3,916,478 11/1975 Shotwell ..... 16/116 R 4,035,865 7/1977 McRae ..... 16/114 R 4,283,808 8/1981 Beebe ..... 16/114 R

*Primary Examiner*—James M. Meister

*Assistant Examiner*—John L. Knoble

*Attorney, Agent, or Firm*—Anthony F. Cuoco

[57] ABSTRACT

An inflatable implement handle for use by the manually impaired is disclosed. The handle carries a pocket for interchangeably receiving an implement such as a pencil, an eating utensil or other implement when the handle is deflated. Upon inflation, a resilient handle for the implement is provided, with the walls of the pocket exerting a force against the implement whereby the implement is retained by the handle. The handle may be inflated to various degrees of resiliency to accommodate the extent of manual impairment of a user.

6 Claims, 5 Drawing Figures

INFLATABLE IMPLEMENT HANDLE

BACKGROUND OF THE INVENTION

Those with poor hand muscle and/or motor control caused by, for example, arthritic conditions, post-operative conditions, general physical weakness or other manual impairments have difficulty in grasping conventional implements such as pencils, pens, eating utentils or the like. While attempts have been made to construct handles for such implements to accommodate users suffering from these impairments, these attempts have not heretofore been entirely satisfactory. For example, prior art handles for the purposes described, while recognizing the grasping difficulty of the user, have been of a rigid material and hence have not addressed the hand or finger sensitivity of the user as often exists. While foam rubber or like materials have been used as covers or cushions, a totally resilient handle providing the maximum degree of comfort and utility has not heretofore been provided.

The present invention accommodates the aforenoted and other requirements of the manually impaired by providing an inflatable and hence totally resilient handle. The invention provides a handle usable with a variety of interchangeable implements and which accommodates a variety of manual impairments. The handle is portable so as to be easily carried, and is easily stored when deflated and not in use.

SUMMARY OF THE INVENTION

This invention contemplates an inflatable implement handle for use by the manually impaired, including an inflatable body having a longitudinally extending pocket. The pocket receives an interchangeable implement when the handle is deflated and when the handle is inflated the walls of the pocket exert a force on the implement for tightly retaining said implement in the body. The handle is inflatable to various degrees of resiliency commendurate with the manual capabilities of the user. Upon deflation, the interchangeable implement releases from the handle and the handle may be used with another implement or stored, as the case may be. To these ends the handle may be of any suitable gauge inflatable material which is appropriately sealed to provide a continuous inflatable and leak proof handle as is required for the purposes intended.

DETAILED DESCRIPTION OF THE INVENTION

Figure 1:
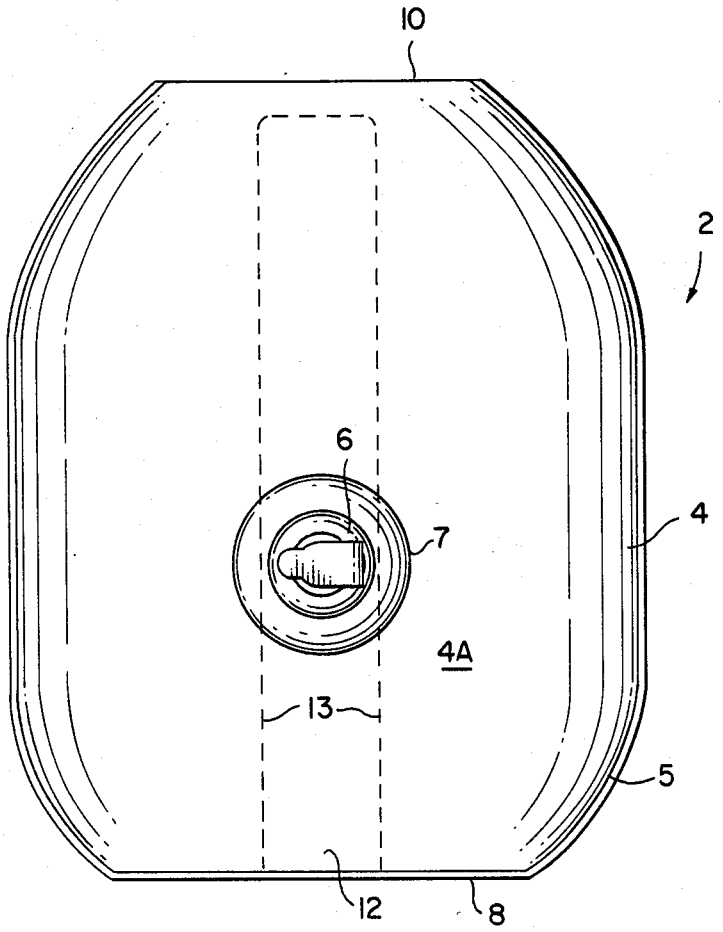
FIG. 1 is a top plan view of an inflatable implement handle according to the invention, with said handle being shown in the deflated state.
Figure 2:
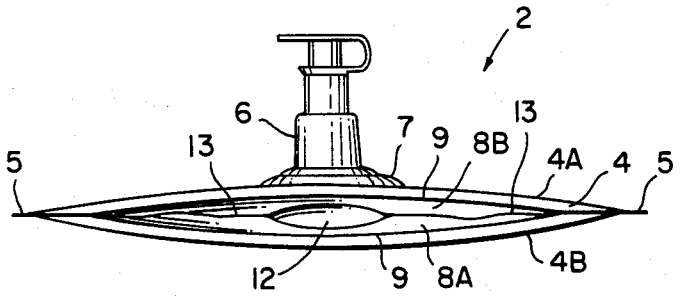
FIG. 2 is a front end view of the handle of the invention, the top view of which is shown in FIG. 1, with said handle being shown in the deflated state.

With reference first to FIGS. 1 and 2, the handle of the invention is designated generally by the numeral 2 and includes a substantially oblong body 4 having top and bottom walls 4A and 4B, respectively, which are circumferentially joined as by heat sealing, cementing or the like at 5.

One of the walls 4A and 4B, such as 4A shown in the Figures, has an inflation/deflation valve 6 disposed on the surface thereof and suitably joined thereto as at 7. The purpose of valve 6 will be hereinafter more fully explained.

Body 4 has a front wall 8 and a rear wall 10, with walls 8 and 10 separating top and bottom walls 4A and 4B. In this connection the front and rear walls are circumferentially joined as by heat sealing, cementing or the like to the body walls as at 9. Rear wall 10 is a continuous wall as in front wall 8. Front wall 8 has lower and upper sections 8A and 8B, respectively, and extends longitudinally within body 4 to form a longitudinally extending pocket 12.

With reference now particularly to FIG. 2, pocket 12 is provided substantially in the center of sections 8A and 8B, with the sections being laterally joined on either side of pocket 12 and longitudinally joined on either side of the pocket as at 13. The particular structural configuration of front wall 8 will be hereinafter more fully explained with reference to FIG. 4.

In connection with FIGS. 1 and 2, it is noted that the invention is shown in the deflated state as will now be understood.

Figure 3:
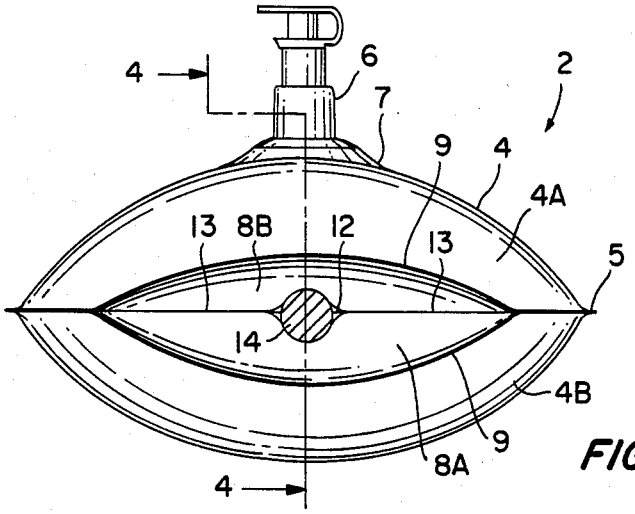
FIG. 3 is a front end view of the handle of the invention, with the handle shown in the inflated state and with an interchangeable implement retained by the handle.
Figure 4:
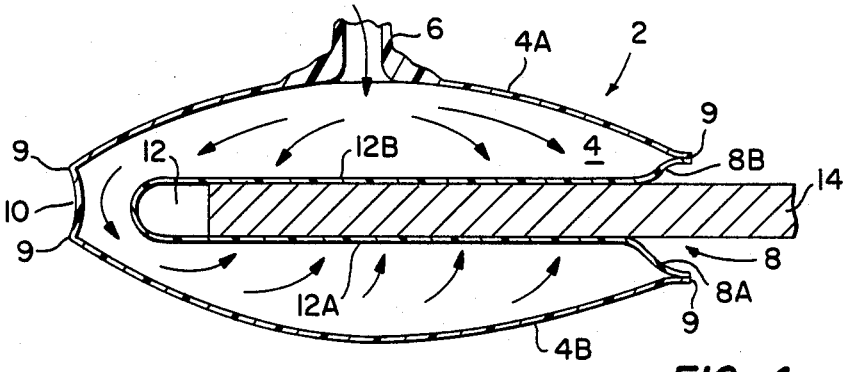
FIG. 4 is a sectionl view taken along line 4—4 in FIG. 3.

Reference will now be made to FIGS. 3 and 4, wherein the invention is shown in the inflated state as accomplished by a suitable quantity of air entering through valve 6 as by blowing into the valve or via a pump-like device (not shown) coupled thereto.

When body 4 is inflated, top and bottom walls 4A and 4B of body 4 expand as does rear wall 10 and front wall 8. Before the body is inflated, that is when the body is as shown in FIGS. 1 and 2, an interchangeable implement 14 which may be a pencil, pen, eating utensil or other like implement is inserted into pocket 12. The inflation of body 4 causes pressure to be exerted on the sides of pocket 12, wherein implement 14 is retained therein as will next be described with reference to FIG. 4.

Thus, with particular reference to FIG. 4, pocket 12 is seen to be formed when wall 8 extends longitudinally within body 4 as aforenoted. Upon inflation of body 4 as by air entering through valve 6 and circulating within body 4 as shown by the arrows in FIG. 4, body walls 4A, 4B puff out or expand, with the entering air exerting a force on pocket walls 12A, 12B so as to retain interchangeable implement 14 within the pocket.

In practising the invention implement 14 is inserted in pocket 12 with body 4 in the deflated state as shown in FIGS. 1 and 2 and as aforenoted. The inflation of the body tightly retains implement 14 within the pocket so that the implement is readily usable in conjunction with handle 2. Upon valve 6 being operated to release the air in the body the force is relieved and the implement is released.

Figure 5:
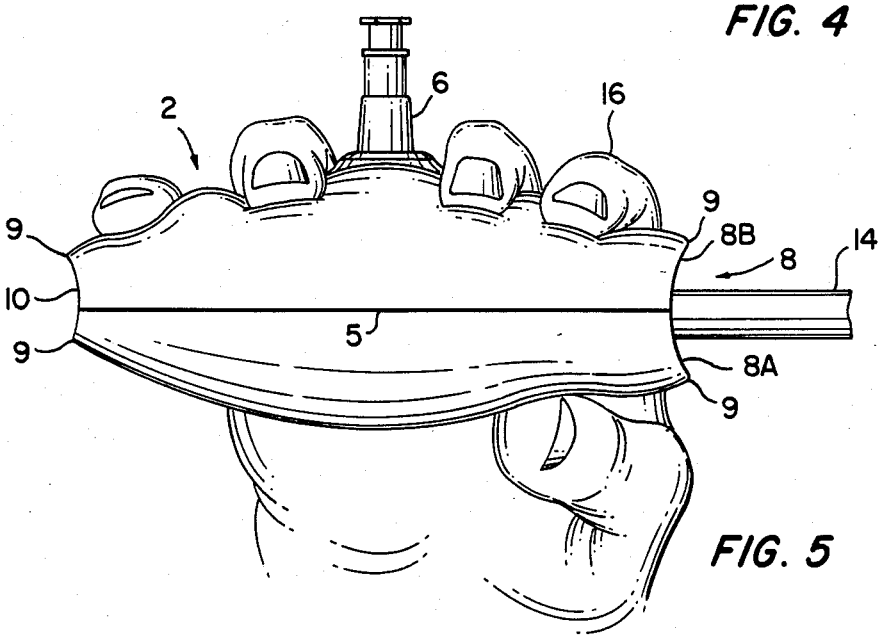
FIG. 5 is a pictorial representation showing the handle of the invention in the inflated state with the interchangeable implement retained therein, and showing the handle grasped by the hand of a user.

With reference to FIG. 5 the inflated body is shown grasped by a hand 16 of a user as will now be understood by those skilled in the art. Body 4 can be inflated to various degrees of resiliency to accommodate the finger or hand sensitivity of particular user as will also be understood. Handle 2 is thus a totally resilient member which provides maximum utility to accommodate the user's manual impairment.

There has heretofore been described an inflatable implement handle for use by those with manual impairments resulting in poor hand muscle and/or motor control. A handle is provided which may be inflated to various degrees to accommodate the extent of the manual impairment and which, when inflated, firmly grasps an interchangeable implement so that the implement may be used as intended. The handle is a totally resilient member and thus has distinct advantages over handles for like purposed which have heretofore been known in the art. The resiliency of the handle provides an additional feature which is most advantageous to those likely to have the need therefor. That is to say, the resilient handle may serve the purpose of an exerciser whereby the user alternately squeezes and releases the handle, with the handle thereby serving a therapeutic purpose.

What is claimed is:

1. An inflatable implement handle for use by the manually impaired, comprising:

a substantially oblong inflatable handle including top and bottom walls circumferentially joined together and front and rear walls separating the top and bottom walls and circumferentially joined thereto;

the front and rear walls being continuous walls, with the front wall having upper and lower sections extending longitudinally within the handle to provide a longitudinally extending internal pocket substantially in the center of the front wall;

the upper and lower sections of the front wall being laterally and longitudinally joined on either side of the pocket;

valve means arranged with one of the top and bottom walls and operable for permitting the handle to be inflated to a degree of resiliency commensurate with the manual impairment of a user, and for being deflated;

an implement interchangeably received in the pocket before the handle is inflated;

a force being exerted on the pocket for retaining the implement therein when the handle is inflated; and the force being relieved for releasing the implement from the pocket when the handle is deflated.

2. An inflatable implement handle for use by the manually impaired, comprising:

the inflatable handle having a longitudinally extending internal pocket for receiving an interchangeable implement when the handle is deflated;

valve means arranged with the handle and operable for permitting the handle to be inflated to various degrees of resiliency commensurate with the degree of manual impairment of the user, and to be deflated;

a force being exerted on the pocket for retaining the implement therein when the handle is inflated; and the force being relieved for releasing the implement from the pocket when the handle is deflated.

3. An inflatable implement handle as described by claim 2, wherein:

the inflatable handle is substantially oblong and includes top and bottom walls and front and rear walls separating the top and bottom walls; and the valve means is arranged with one of the top and bottom walls.

4. An inflatable implement handle as described by claim 3, wherein:

the top and bottom walls are circumferentially joined to each other and the front and rear walls are circumferentially joined to the top and bottom walls.

5. An inflatable implement handle as described by claim 2, wherein:

the front and rear walls are continuous walls;

the front wall has upper and lower sections which extend longitudinally within the handle to provide the longitudinally extending internal pocket;

the pocket is provided substantially in the center of the upper and lower front wall sections; and the upper and lower sections are laterally and longitudinally joined on either side of the pocket.

6. An inflatable implement handle as described by claim 2, wherein:

the handle expands upon being inflated, whereupon the force exerted on the longitudinally extending internal pocket acts to retain the implement within the pocket; and the handle collapses upon being deflated, whereupon the force on the pocket is relieved and the implement is released from the pocket.

* * * * *